US005782316A

United States Patent [19]

Kobayashi et al.

[11] Patent Number: 5,782,316

[45] Date of Patent: Jul. 21, 1998

[54] RECIPROCATING PISTON VARIABLE DISPLACEMENT TYPE COMPRESSOR IMPROVED TO DISTRIBUTE LUBRICATING OIL SUFFICIENTLY

[75] Inventors: Hisakazu Kobayashi; Youichi Okadome; Masaru Hamasaki; Masaki Ota, all of Kariya, Japan

[73] Assignee: Kabushiki Kaisha Toyoda Jidosokki, Kariya, Japan

[21] Appl. No.: 812,321

[22] Filed: Mar. 5, 1997

[30] Foreign Application Priority Data

Mar. 6, 1996 [JP] Japan ..... 8-048903

[51] Int. Cl.[6] ..... F01M 1/00

[52] U.S. Cl. ..... 184/6.17; 92/154; 92/12.2; 417/269; 91/499

[58] Field of Search ..... 92/71, 12.2, 154; 91/499, 500, 504, 505; 184/6.17; 417/269

[56] References Cited

U.S. PATENT DOCUMENTS

| | | | |
|---|---|---|---|
| 4,070,136 | 1/1978 | Nakayama et al. | 184/6.17 |
| 4,321,019 | 3/1982 | Degawa et al. | 417/269 |
| 4,326,838 | 4/1982 | Kawashima et al. | 417/269 |
| 4,586,876 | 5/1986 | Kato et al. | 184/6.17 |
| 5,088,897 | 2/1992 | Kawai et al. | 417/269 |

FOREIGN PATENT DOCUMENTS

| | | |
|---|---|---|
| 62-674 | 1/1987 | Japan . |
| 62-276279 | 12/1987 | Japan . |

*Primary Examiner*—Thomas E. Denion
*Attorney, Agent, or Firm*—Burgess, Ryan & Wayne

[57] ABSTRACT

A reciprocating piston type compressor for compressing refrigerant gas for an automobile air conditioning system is provided with a cylinder block assembly which includes a plurality of cylinder bores, a swash plate chamber and an oiler channel which extends along the one of the end walls of the swash plate chamber. When the refrigerant gas, which flows rotationally in the swash plate chamber due the rotating swash plate, contacts the oiler channel, the lubricating oil mist, in the refrigerant gas flow in the swash plate chamber induced by the rotation of the swash plate, is separated from the refrigerant gas and the separated lubricating oil is introduced into the bearing means by the oiler channel.

12 Claims, 4 Drawing Sheets

RECIPROCATING PISTON VARIABLE DISPLACEMENT TYPE COMPRESSOR IMPROVED TO DISTRIBUTE LUBRICATING OIL SUFFICIENTLY

BACKGROUND OF THE INVENTION

1. Field of the Invention

The present invention relates to a lubricating system in a reciprocating piston type compressor for use in an automobile air conditioning system.

2. Description of the Related Art

A reciprocating piston variable displacement type refrigerant compressor for use in an automobile air conditioning system in known in the art. Such a compressor comprises a cylinder block including a plurality of parallel cylinder bores arranged around an axial drive shaft, and single-headed pistons slidably provided within the cylinder bores for reciprocating between the top dead center and the bottom dead center. A drive mechanism is provided to reciprocate the single-headed pistons is well known. The drive mechanism comprises an axially extending drive shaft which is operatively connected to an automobile engine, and a swash plate which is mounted on the drive shaft by a tilting mechanism for changing the angle of the swash plate relative to the drive shaft. The swash plate is engaged with the single-headed pistons through shoes mounted on the respective pistons, and is supported by a pair of thrust bearings.

The compressor is driven by the automobile engine, which operation changes significantly within a wide range of the rotational speed. The rotational speed of the compressor also changes significantly within a wide range. If a sufficient lubrication is not provided for the bearings at high speed rotation, then the life of the compressor is reduced due to wear of the bearing.

In a compressor of a type described above, a swash plate chamber provides a reservoir for the lubricating oil. The lubricating oil is distributed to the parts, where relative movements between parts take place, by a blowby gas of refrigerant accompanied by an oil mist and by a centrifugal flow of the lubricating oil within the swash plate chamber caused by the rotating swash plate.

When a variable displacement reciprocating piston type compressor is driven at high rotational speed and at a relatively low displacement operation, the flow rate of the refrigerant gas is reduced and insufficient lubrication is provided. This may result in seizing in moving parts in the compressor to reduce the reliability of the compressor.

The invention is directed to solve the prior art problem described above, and to provide a variable displacement reciprocating piston type compressor improved to distribute the lubricating oil sufficiently in the compressor.

SUMMARY OF THE INVENTION

According to the invention, a reciprocating piston type compressor for compressing refrigerant gas for an automobile air conditioning system is provided. The refrigerant gas contains a lubricating oil in the form of a mist. The compressor comprises a cylinder block assembly which includes a plurality of axially extending cylinder bores arranged around the longitudinal axis of the cylinder block assembly and a cylindrical swash plate chamber aligned with the longitudinal axis of the cylinder block assembly. In particular, the swash plate chamber is defined by opposite end walls and a circumferential wall between the opposite end walls, which are included in the cylinder assembly.

A plurality of pistons are slidably provided within the cylinder bores for reciprocation between the top and bottom dead centers. The inner wall of the cylinders and the end face of the pistons defines compression chambers, and a low pressure refrigerant gas is introduced into the compression chambers through the swash plate chamber. An axially extending drive shaft is provided for driving the motion of the reciprocating pistons. The drive shaft is mounted to the cylinder block assembly by a bearing means for rotation. A swash plate is mounted to the drive shaft for rotation with the drive shaft within the swash plate chamber. The swash plate engages the pistons to transform the rotation of the swash plate to the reciprocation of the pistons. The cylinder block assembly further includes an oiler channel which extends along the one of the end walls of the swash plate chamber. When the refrigerant gas, which flows rotationally in the swash plate chamber due the rotating swash plate, contacts the oiler channel, the lubricating oil mist, in the refrigerant gas flow in the swash plate induced by the rotation of the swash plate, is separated from the refrigerant gas, and the separated lubricating oil is introduced into the bearing means by the oiler channel.

According to another feature of the invention, the cylinder block assembly further includes a ridge which axially inwardly extends from the inner end wall along the circumferential wall. The oil mist in the refrigerant gas flow in the swash plate chamber is trapped by the ridge and the trapped oil mist is introduced into the oiler channel.

Preferably, the oiler channel is provided in the one of the opposite end walls of the swash plate chamber at a portion of the upper half of the end wall and on the downstream quadrant relative to the flow direction of the refrigerant gas in the swash plate chamber.

According to another feature of the invention, the cylinder block assembly further includes an inlet port, which provide a fluid communication between the automobile air conditioning system and the swash plate, for introducing the refrigerant gas into the swash plate chamber, and the ridge extends parallel to the axis of the cylinder block assembly from the end wall of the swash plate chamber to the opening of the inlet port of the cylinder block assembly.

BRIEF DESCRIPTION OF THE DRAWINGS

These and other objects and advantages and further description will now be discussed in connection with the drawings in which.

DESCRIPTION OF THE PREFERRED EMBODIMENTS

Figure 1:
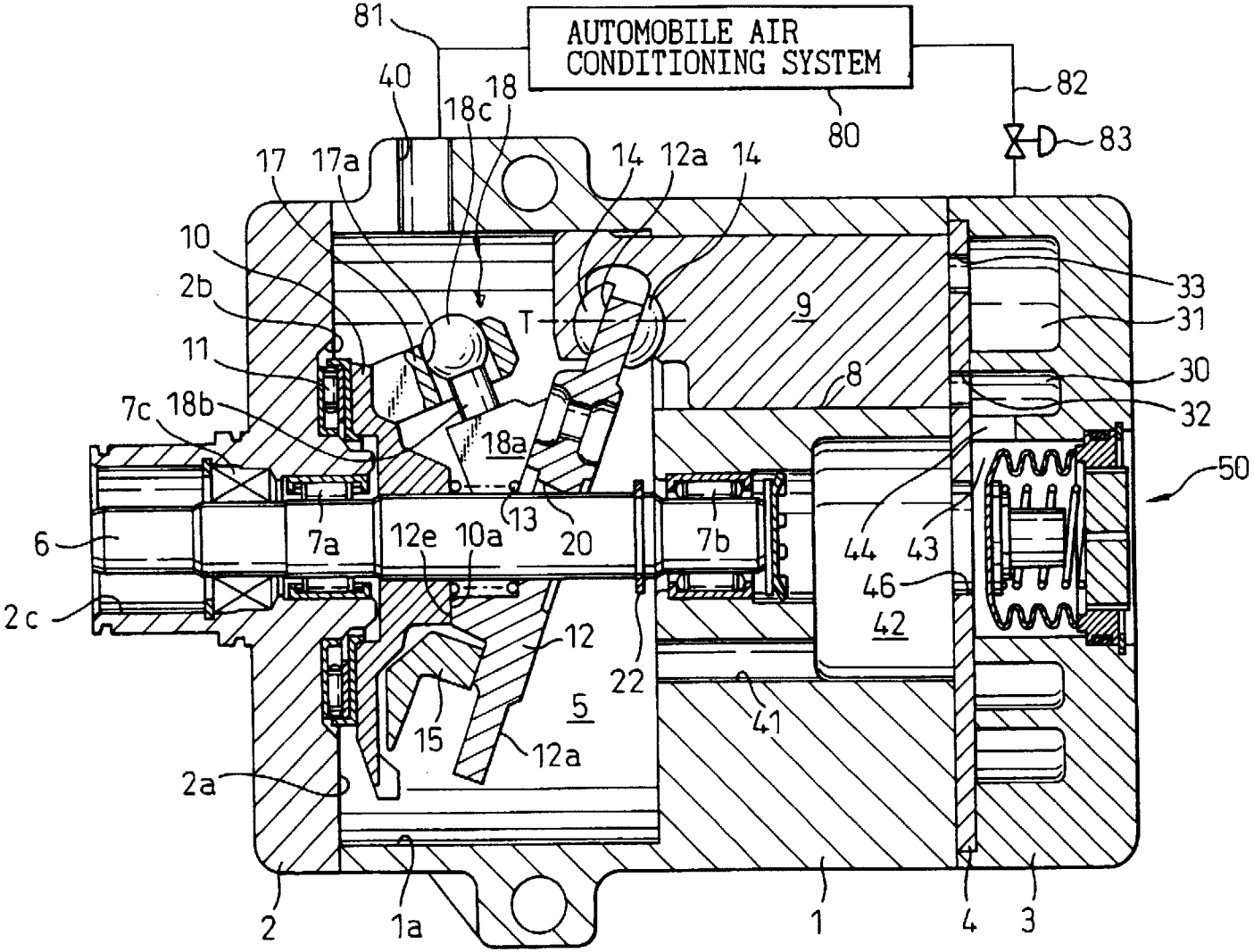
FIG. 1 is a longitudinal section of a reciprocating piston type compressor according to an embodiment of the invention.
Figure 2:
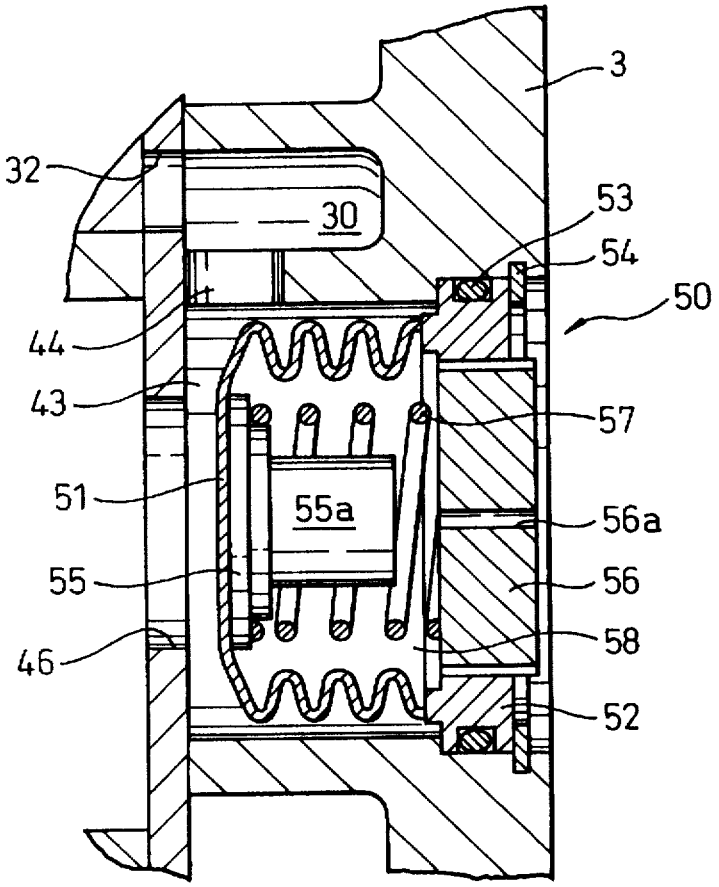
FIG. 2 is an partial enlarged section of the compressor of FIG. 1 showing a control valve for controlling the differential pressure on pistons.

In FIGS. 1 and 2, a variable displacement reciprocating piston type compressor according to an embodiment of the invention is illustrated. The compressor can be used for an automobile air conditioning system, and is provided with a cylinder block 1, a front housing 2 with an inner surface 2*a* and a rear housing 3, which are axially connected together by means of screw bolts (not shown) to form an integral cylinder block assembly. The valve plate 4 is sealingly arranged between the cylinder block 1 and the rear housing 3. An axially extending drive shaft 6 is mounted to the cylinder block assembly for rotation by a pair of radial bearings 7*a* and 7*b*.

The integral cylinder block assembly includes a plurality of cylinder bores 8 arranged about the drive shaft 6, and a swash plate chamber 5 within which a swash plate 12 is mounted on the drive shaft 6 through a tilting mechanism 18. In particular, the swash plate chamber 5 is defined by opposite end walls and a circumferential wall between the end walls. The inner surface 2*a* of the front housing 2 provides one of the end walls. The tilting mechanism 18 enables the swash plate 12 to move between a maximum displacement position shown in FIG. 1, and a minimum displacement position where the swash plate 12 abuts a stop ring 22 and is substantially perpendicular to the drive shaft 6.

The cylinder block 1 further includes a plurality of refrigerant gas passages 41 arranged about the drive shaft 6 alternatively with the cylinder bores 8. The refrigerant gas passages 41 extend parallel to the drive shaft 6 from the swash plate chamber 5 to a manifold chamber 42 provided in the rear end of the cylinder block 1.

One end of the drive shaft 6, i.e., a front end of the drive shaft 6, extends outwardly through a shaft bore 2*c* included in the front housing 2, so that the compressor can be operatively connected to an automobile engine (not shown) via an electromagnetic clutch (not shown) provided on the end of the driving shaft 6 and a V-belt (not shown) extending between the electro-magnetic clutch and a crank pulley of the automobile engine. A seal 7*c* is provided in the shaft bore 2*c* to prevent the refrigerant gas from leaking between the shaft bore 2*c* and the drive shaft 6.

The cylinder bores 8 are equally spaced in the integral cylinder block assembly about the axis of the drive shaft 6. Within the cylinder bores 8, single-headed pistons 9 are slidably provided for reciprocation between top and bottom dead centers. The inner surface of the respective cylinder bores 8 and the ends of the single-headed pistons 9 define compression chambers.

The swash plate 12 engages the single-headed pistons 9 through shoes 14 which are socketed in the respective pistons 9. Thus, the rotation of the drive shaft 6 is converted into the reciprocation of the single-headed pistons 9 within the cylinder bores 9 via the swash plate 12.

The rear housing 3 includes a suction camber 30 in the form of a ring and a discharge chamber 31 in the form of a ring. The suction and discharge chambers 30 and 31 are fluidly connected to the compression chambers through suction and discharge ports 32 and 33, respectively. The rear housing 6 further includes a control chamber 43 which fluidly communicates with the manifold chamber 42 through an orifice 46 provided in the valve plate 4, and the suction chamber 30 through a passage 44. Within the control chamber 43, a control valve 50 is provided.

With reference to FIG. 2, the control valve 50 is provided within the control chamber 43 which is defined by an axial through hole provided in the rear housing 3. The control valve 50 comprises a bellows 51 secured to a mounting ring 52. The mounting ring 52 is mounted to the rear housing 3 to close an outer end opening by a locating snap ring 54. An O-ring 53 is fitted into a circumferential groove of the mounting ring 52 to seal between the mounting ring 52 and the inner wall of the control chamber 43. The mounting ring 52 includes a threaded through hole to which a base plate 56 with an orifice 56*a* is threadedly connected.

On the inner surface of the end wall of the bellows 51, a spring seat 55 is provided to bear a spring 57, which is provided between the spring seat 55 and the base plate 56 to bias the bellows 51 to axially inward direction. The spring seat 55 includes a protrusion 55*a* which can abut the inner end face of the base plate 56 to limit the axial outward movement of the bellows 51 and the spring seat 55. Thus, the control valve 50 can move between an open position where bellows 51 axially outwardly moves and the protrusion 55*a* abuts the base plate 56 so that the pressure of the refrigerant gas which flows along the flow path between the orifice 46 and the passage 44 is not substantially reduced, and a closed position where the bellows 51 abuts the valve plate 4 to block the orifice 46. Rotating the threaded base plate 56 changes the spring force for biasing the bellows 51 in the axially inward direction.

Referring to FIG. 1 again, the tilting mechanism 18 includes a pair of brackets 18*a* (only one is illustrated), provided parallel to the plane of the drawing, to which a pair of guide pins 18*b* (only one is illustrated) is connected. The tilting mechanism 18 further includes a counter balancer 15 which is provided diametrically opposite to the brackets 18, and a rotor 10 which is mounted on the drive shaft 6 to rotate therewith. Provided within a recess 2*b*, which is included in the inner surface 2*a* of the front housing 2, is a thrust bearing 11 for bearing the thrust load on the rotor 10. The rotor 10 includes a pair of supports 17 (only one of them is illustrated), provided parallel to the plane of the drawing, for supporting and guiding the guide pins 18*b*. In particular, the supports 17 include guiding holes 17*a* into which spherical heads 18*c* are movably fitted with the surfaces of the heads 18*c* contacting the inner surfaces of the guiding holes 17*a*. The guiding holes 17*a* are provided so that the swash plate 12 moves one of the single-headed pistons 9, which is aligned with the center line of the pair of the supports 17, to the top dead center as shown in FIG. 1.

According to the embodiment, the differential pressure applied to the pistons 9, that is the differential pressure of the refrigerant gas between within the swash plate chamber 5 and the suction chamber 30 adjusts the angle of the swash plate 12 relative to the drive shaft 6 automatically.

The compressor is fluidly connected to an automobile air conditioning system 80 through a low pressure conduit 81 which communicates with the swash plate chamber 5 through an inlet port 40, and through a high pressure conduit 82 which communicates with the discharge chamber 31 through an outlet port (not shown) provided on the rear housing 3. The air conditioning system 80 is of a type which is well known in the art, and includes an evaporator and an expansion valve 83 provided on the high pressure conduit 82 to reduce the pressure of the compressed refrigerant gas so that the temperature of the expanded refrigerant gas is reduced. The expansion valve 83 also controls the flow rate of the refrigerant.

Figure 3:
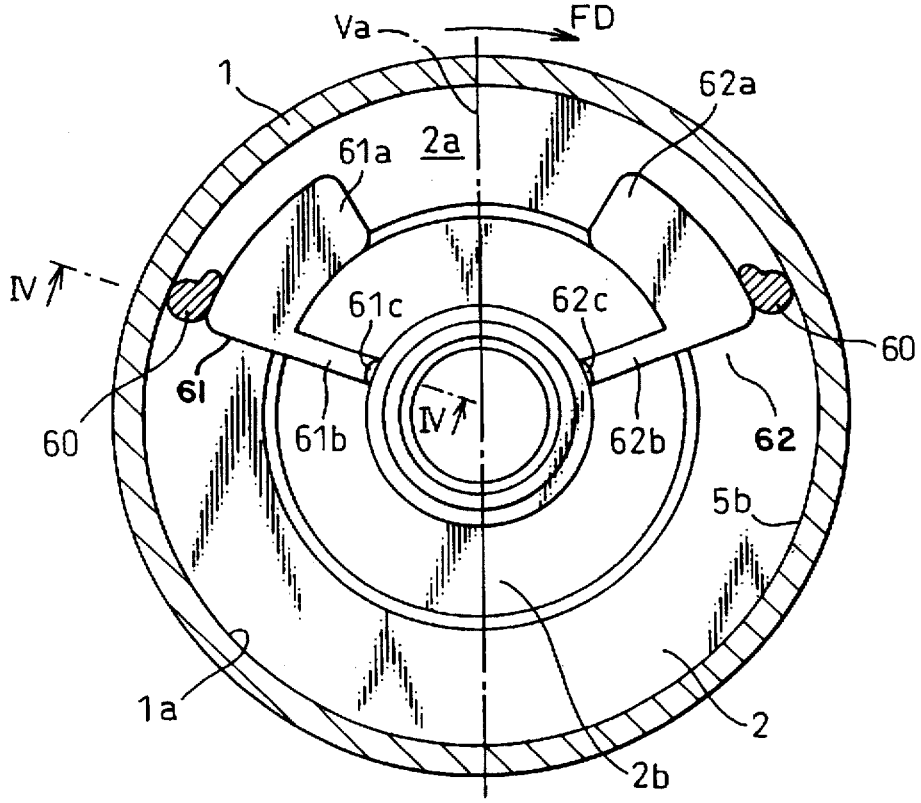
FIG. 3 is an end view of the compressor of FIG. 1 along line III—III in FIG. 4.
Figure 4:
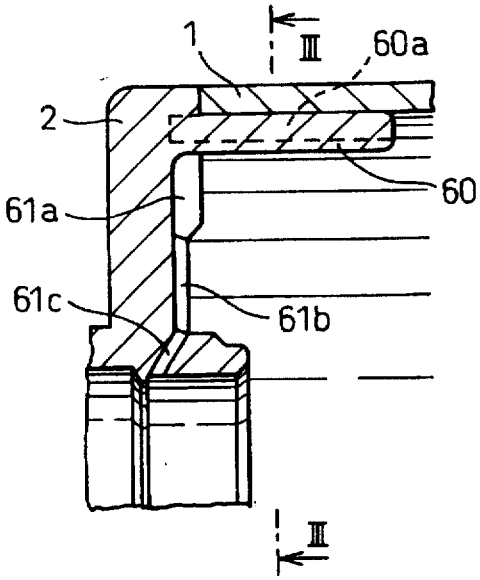
FIG. 4 is a partial section of an oiler channel along a line IV—IV in FIG. 3.

With reference to FIGS. 3 and 4, the front housing 2 includes a pair of oiler channel portions 61 and 62 on the inner end face 2*a* for introducing the lubricating oil into the bearings 7*a* and 11 and the seal 7*c* which are provided in the frontal area of the compressor. As shown in FIG. 3, according to the embodiment of the invention, the oiler channels 61 and 62 are preferably provided symmetrically relative to the vertical axis Va on the upper half portion of the inner surface 2a of the front housing 2. However, only a single oiler passage can be provided on the downstream quadrant, relative to the vertical axis Va, of the refrigerant flow in the swash plate chamber 5 indicated by an arcuate arrow FD.

The oiler channels 61 and 62 include enlarged channel portions 61a and 62a substantially in the form of sectors which extend along the inner surface 2a of the front housing 2 about the axis of the cylinder block assembly, radially extending channel portions 61b and 62b, and passages 61c and 62c extending from the radially inner ends of the channel portions 61b and 62b to the inner surface of the shaft bore 2c into which the bearing 7a and the seal 7c are provided. In particular, the passages 61c and 62c open into the inner surface of the shaft bore 2c at a region between the bearing 7a and the seal 7c.

The front housing 2 further includes a pair of trapping ridges 60, in the form of a gutter which extend from the inner surface 2a of the front housing 2 parallel to the axis of the compressor.

The functional operation of the compressor according to the aforementioned embodiment will be described.

When the automobile air conditioning system 80 is deactivated, the pressure of the refrigerant gas within the air conditioning system 80 and the compressor, in particular, within the low pressure conduit 81, the swash plate chamber 5, refrigerant gas passages 41, and the manifold chamber 42 is higher than the atmospheric pressure. Thus, the control valve 50 is in the open position where the bellows 52 is axially outwardly moved by the differential pressure between the internal pressure of the compressor and the atmospheric pressure.

When the automobile air conditioning system is activated, the electromagnetic clutch is activated so that the rotational power is transmitted to the drive shaft 6. The rotation of the drive shaft 6 is transformed to the reciprocation of the pistons 9 to compress the refrigerant gas through the rotating swash plate 12. The rotation of the swash plate 12 also induces a rotational flow component of the refrigerant gas within the swash plate chamber 5. The compressed refrigerant gas is discharged from the compressor to the automobile air conditioning system 80, in particular to the evaporator (not shown) provided in the air conditioning system 80, with the pressure of the refrigerant gas reduced by the expansion valve 83 on the high pressure conduit 82. During the starting period of the compressor, the control valve 50 is in the open position so that the pressure of the refrigerant gas which flows therethrough is not substantially reduced. Therefore, the swash plate is maintained at the maximum displacement position.

When the temperature in the compartment of the automobile is high, the expansion valve 83 moves toward an open position to increase the flow rate of the refrigerant to the evaporator. However, when the operation of the automobile air conditioning system reduces the temperature in the compartment, the expansion valve 83 moves toward a closed position to reduce the flow rate of the refrigerant. The lower the temperature of the air in the compartment is, the lower the evaporation in the evaporator results since the expansion valve reduces the flow rate of the compressed refrigerant gas.

This further results in a reduced flow rate of the refrigerant to the compressor through the low pressure conduit 81. Thus, the pressure within the swash plate chamber 5, to which the low pressure conduit 81 is connected through the inlet port 40, is reduced. Then, the control valve 50 moves toward the closed position so that the bellows 51 obstructs the flow of the refrigerant gas which flows through the control valve 50 to reduce the pressure thereof. Reduced pressure of the refrigerant gas within the suction chamber moves the swash plate 12 toward the minimum displacement position.

With swash plate 12 at the minimum displacement position, the flow rate of the refrigerant gas into the swash plate chamber 5 reduces to the minimum flow. The lower the flow rate of the refrigerant gas into the swash plate chamber 5, the lower the flow rate of the lubricating oil in the form of a mist in the inflow of the refrigerant gas introduced into the swash plate chamber 5. In a compressor of the prior art, insufficient lubrication for moving parts, corresponding to the bearings 7a and 11 and the seal 7c of the embodiment, results.

The invention can remove this problem. According to the embodiment of the invention, the contact of the refrigerant gas flow, containing the lubricating oil mist, with the enlarged channel portions 61a and 62a separates the lubricating oil efficiently to provide sufficient lubricating oil to the moving parts of the compressor. The sector from of the enlarged channels 61a and 62a effectively functions to contact the rotational flow of the refrigerant gas in the swash plate chamber, and to separate the oil mist from the refrigerant flow. Further, the trapping ridges 60 aid the separation of the lubricating oil mist from the refrigerant gas flow.

Figure 5:
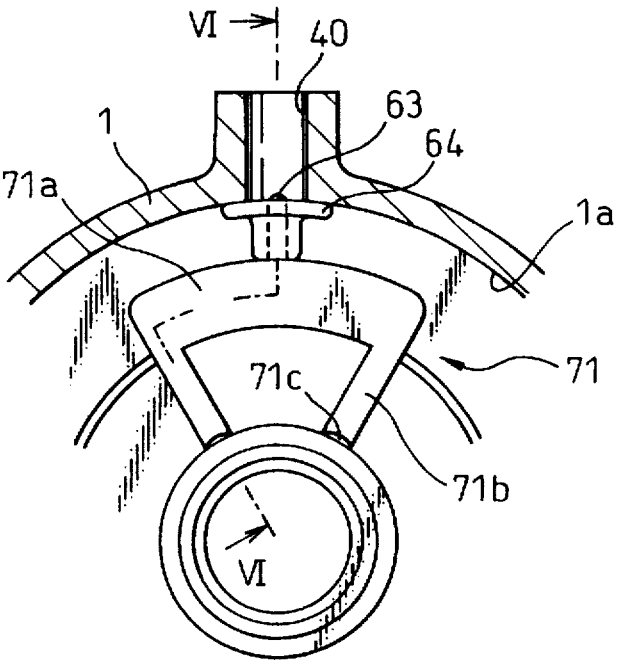
FIG. 5 is a partial end view of the compressor according to another embodiment of the invention along a line V—V in FIG. 6.
Figure 6:
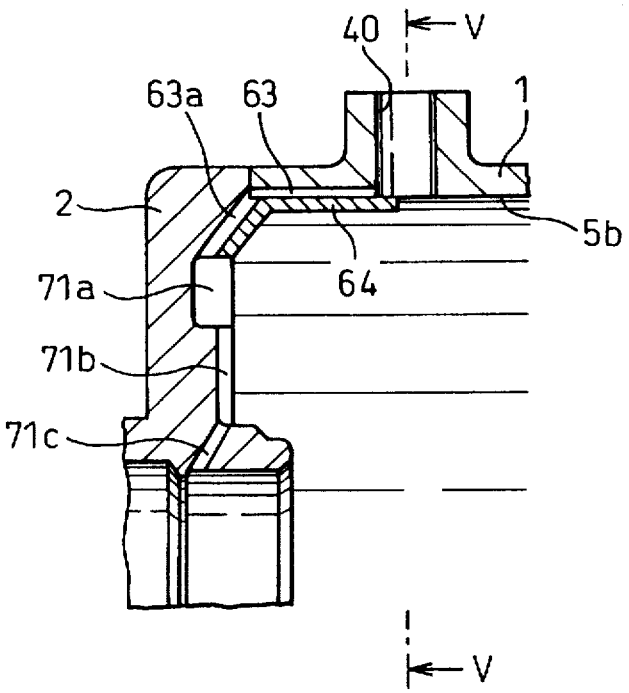
FIG. 6 is a partial section of the compressor along a line VI—VI in FIG. 5.

With reference to FIGS. 5 and 6, another embodiment of the invention will be described. In FIGS. 5 and 6, elements similar to those of the aforementioned embodiment are indicated by the same reference numbers.

According to the embodiment of FIGS. 5 and 6, the inner surface 2a of the front housing 2 includes an oiler channel 71. The oiler channel 71 includes an enlarged channel portion 71a substantially in the form of a sector extending along the inner surface 2a of the front housing about the axis of the cylinder block assembly and a pair of radial channel portions 71b which extend from the sector channel 71a to the inner surface of the shaft bore 2c as in the aforementioned embodiment. A ridge 64 extends parallel to the axis of the compressor from the inner surface 2a of the front housing 2 to the opening of the inlet port 40 so that a channel 63 is provided along the ridge for introducing lubricating oil into the oiler channel 71. A substantial part or the lubricating oil mist in the inflow of the refrigerant gas through the inlet port 40 is efficiently separated when the inflow encounters the end of the ridge 64. The separated lubricating oil flows along the channel 63 to the oiler channel 71. Then, the lubricating oil is further led to the bearings 7a and 11 and the sealing 7c.

It will also be understood by those skilled in the art that the forgoing description is a preferred embodiment of the disclosed device and that various changes and modifications may be made without departing from the spirit and scope of the invention.

We claim:

1. A reciprocating piston-type compressor for compressing refrigerant gas for an automobile air conditioning system, the refrigerant gas containing a lubricant oil in the form of a mist, the compressor comprising:

a cylinder block assembly which includes a plurality of axially extending cylinder bores arranged around the longitudinal axis of the cylinder block assembly and a cylindrical swash plate chamber aligned with the longitudinal axis of the cylinder block assembly, the swash plate chamber defined by opposite end walls and a circumferential wall between the opposite end walls, which are included in the cylinder assembly;

a plurality of pistons slidably provided within the cylinder bores for reciprocation between the top and bottom dead centers, the inner wall of the cylinders and the end face of the pistons defining compression chambers, a low pressure refrigerant gas being introduced into the compression chambers through the swash plate chamber;

an axially extending drive shaft for driving the reciprocating pistons, the drive shaft being arranged in the cylinder block assembly with a bearing means for rotation;

a swash plate arranged on the drive shaft for rotation with the drive shaft, the swash plate engaging the pistons to transform the rotation of the swash plate to the reciprocation of the pistons; and the cylinder block assembly including an oiler channel which extends along one of the end walls of the swash plate chamber to separate the lubricating oil mist in the refrigerant gas flow in the swash plate chamber induced by the rotating swash plate when the refrigerant gas contacts the oiler channel, and to introduce the separated lubricating oil into the bearing means.

2. The reciprocating piston type compressor according to claim 1, in which the cylinder block assembly further includes an inwardly protecting ridge which axially extends from the inner end wall along the circumferential wall to trap the oil mist in the refrigerant gas flow in the swash plate chamber and to introduce the trapped oil mist to the oiler channel.

3. The reciprocating piston type compressor according to claim 2, in which the oiler channel is provided in one of the opposite end walls of the swash plate chamber at a portion of an upper half of the end wall and on a downstream quadrant relative to the flow direction of the refrigerant gas in the swash plate chamber.

4. The reciprocating piston type compressor according to claim 3, in which the cylinder block assembly further includes an inlet port, which provides a fluid communication between the automobile air conditioning system and the swash plate, for introducing the refrigerant gas into the swash plate chamber; and the ridge extends parallel to the axis of the cylinder block assembly from the end wall of the swash plate chamber to the opening of the inlet port of the cylinder block assembly.

5. The reciprocating piston type compressor according to claim 3, in which the compressor further comprises a tilting mechanism, mounted on the drive shaft, for allowing the swash plate to change its angle relative to the drive shaft, and for enabling the compressor to vary its displacement;

the bearing means including a pair of radial bearings for supporting the drive shaft at ends of the drive shaft, and a thrust bearing for bearing the thrust load on the tilting mechanism.

6. The reciprocating piston type compressor according to claim 5, in which a seal member is provided between the drive shaft and the cylinder block assembly at one end of the drive shaft and axially outside of one of the pair of the radial bearings; and the oiler channel arranged to direct the separated lubricating oil to the thrust bearing and to the drive shaft between the seal member and the radial bearing.

7. The reciprocating piston type compressor according to claim 6, in which the oiler channel includes an enlarged channel portion substantially in the form of a sector extending along one of the end walls about the axis of the drive shaft, a radial channel portion extending to the enlarged channel portion.

8. A reciprocating piston type compressor for compressing refrigerant gas for an automobile air conditioning system, the refrigerant gas containing a lubricating oil in the form of a mist, the compressor comprising:

a cylinder block assembly which defines a plurality of axially extending cylinder bores arranged around the longitudinal axis of the cylinder block assembly and a cylindrical swash plate chamber aligned with the longitudinal axis of the cylinder block assembly, the swash plate chamber including opposite end walls and a circumferential wall between the opposite end walls;

a plurality of pistons slidably provided within the cylinder bores for reciprocation between a top and a bottom dead center, an inner wall of the cylinder bores and an end face of the pistons defining compression chambers, a low pressure refrigerant gas being introduced into the compression chambers through the swash plate chamber;

an axially extending drive shaft for driving the reciprocating pistons, the drive shaft being arranged in the cylinder block assembly with a bearing means for rotation;

a swash plate arranged on the drive shaft for rotation with the drive shaft, the swash plate engaging the pistons to transform the rotation of the swash plate to the reciprocation of the pistons; and the cylinder block assembly including an oiler channel which extends along one of the end walls of the swash plate chamber to separate the lubricating oil mist in the refrigerant gas flow in the swash plate chamber induced by the rotation of the swash plate when the refrigerant gas contacts the oiler channel, and to introduce the separated lubricating oil into the bearing means, the oiler channel including an enlarged channel portion in the form of a sector extending along the one of the end walls about the axis of the cylinder block assembly;

the cylinder block assembly further including an inwardly projecting ridge which axially extends from the inner end wall along the circumferential wall to trap the oil mist in the refrigerant gas flow in the swash plate chamber and to introduce the trapped oil mist into the oiler channel.

9. The reciprocating piston type compressor according to claim 8, in which the oiler channel is provided in the one of the opposite end walls of the swash plate chamber at a portion of an upper half of the end wall and on a downstream quadrant relative to the flow direction of the refrigerant gas in the swash plate chamber.

10. The reciprocating piston type compressor according to claim 8, in which the cylinder block assembly further includes an inlet port, which provides a fluid communication between the automobile air conditioning system and the swash plate, for introducing the refrigerant gas into the swash plate chamber; and wherein the ridge extends parallel to the axis of the cylinder block assembly from the end wall of the swash plate chamber to the opening of the inlet port of the cylinder block assembly.

11. The reciprocating piston type compressor according to claim 8, in which the compressor further comprises a tilting mechanism, mounted on the drive shaft, for allowing the swash plate to change its angle relative to the drive shaft, and for enabling the compressor to vary its displacement;

the bearing means including a pair of radial bearings for supporting the drive shaft at ends of the drive shaft, and a thrust bearing for bearing a thrust load on the tilting mechanism.

12. The reciprocating piston type compressor according to claim 11, in which a seal member is provided between the drive shaft and the cylinder block assembly at one end of the drive shaft and axially outside of one of the pair of the radial bearings; and the oiler channel extending to direct the separated lubricating oil to the thrust bearing and to the drive shaft between the seal member and the one of the radial bearings.

* * * * *